US008690274B2

(12) United States Patent
Grützke et al.

(10) Patent No.: US 8,690,274 B2
(45) Date of Patent: Apr. 8, 2014

(54) HOUSEHOLD APPLIANCE INCLUDING GLASS INTERIOR WALLS

(75) Inventors: Joachim Grützke, Egmating (DE); Andrew Roberson, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 126 days.

(21) Appl. No.: 12/955,008

(22) Filed: Nov. 29, 2010

(65) Prior Publication Data

US 2012/0133262 A1 May 31, 2012

(51) Int. Cl.
*A47B 96/04* (2006.01)

(52) U.S. Cl.
USPC ..... 312/406

(58) Field of Classification Search
USPC ..... 312/406, 400–401, 408, 410, 223.5; 362/92
See application file for complete search history.

(56) References Cited

U.S. PATENT DOCUMENTS

| | | | | |
|---|---|---|---|---|
| 2,687,621 | A * | 8/1954 | Fitzgerald | 62/150 |
| 2,995,649 | A * | 8/1961 | Cyrus | 362/92 |
| 7,588,340 | B2 | 9/2009 | Bauer et al. | |
| 7,736,010 | B2 * | 6/2010 | Lee | 362/92 |
| 7,905,614 | B2 * | 3/2011 | Aoki | 362/92 |
| 8,186,844 | B2 * | 5/2012 | Hall | 362/127 |
| 2004/0214010 | A1 * | 10/2004 | Murata et al. | 428/426 |
| 2005/0138892 | A1 * | 6/2005 | Misonou | 52/782.1 |
| 2006/0201181 | A1 * | 9/2006 | Bauer et al. | 62/264 |
| 2006/0250061 | A1 * | 11/2006 | Cheon | 312/401 |
| 2007/0266723 | A1 * | 11/2007 | Lee et al. | 62/264 |
| 2008/0245788 | A1 * | 10/2008 | Choong et al. | 219/758 |
| 2008/0247154 | A1 | 10/2008 | Lim et al. | |
| 2009/0272136 | A1 * | 11/2009 | Knoll et al. | 62/251 |
| 2010/0327720 | A1 | 12/2010 | Pae | |
| 2011/0277493 | A1 * | 11/2011 | Becke et al. | 62/264 |

FOREIGN PATENT DOCUMENTS

| | | | |
|---|---|---|---|
| CN | 2379044 | | 5/2000 |
| DE | 20302742 | U1 | 8/2003 |
| EP | 1990592 | | 11/2008 |
| EP | WO2009101557 | A1 | 8/2009 |
| JP | 2008073153 | A * | 4/2008 |
| WO | WO2010023926 | A1 | 3/2010 |

OTHER PUBLICATIONS

International Search Report PCT/EP2011/070731.

* cited by examiner

*Primary Examiner* — Hanh V Tran
(74) *Attorney, Agent, or Firm* — James E. Howard; Andre Pallapies

(57) ABSTRACT

A household appliance having a housing defining an interior space. In an exemplary embodiment, the housing may include a plurality of internal walls, wherein at least one of the plurality of internal walls is made of a glass material. Further, the interior space may be under a refrigeration condition.

22 Claims, 3 Drawing Sheets

HOUSEHOLD APPLIANCE INCLUDING GLASS INTERIOR WALLS

BACKGROUND OF THE INVENTION

1. Field of the Invention

The present invention relates to a household appliance and more particularly, to a household appliance, such as a refrigerator or freezer, including glass interior walls.

2. Related Art

In a related art household appliance, such as a refrigerator, the interior of the refrigerator is usually illuminated using a light housing or a lamp that is switched on and off on opening and closing the door of the appliance by a switch actuated by the door. The light housing or lamp is mounted on one of the inner walls of the refrigerator, usually on the ceiling area or one of the side walls. As a result of built-in components in the appliance such as base plates, pull-out drawers or door compartments and as a result of food which has been inserted, which act as light barriers, large parts of the appliance are not reached or only inadequately reached by the light emanating from the lamp. Thus, only non-uniform illumination of the interior of the appliance may be possible.

The illumination may also be affected by the material making up the inner walls of the refrigerator, such as stainless steel used in the related art. Additionally, the use of stainless steel for the inner walls naturally creates parting lines between an inner wall and adjacent light housing.

The present invention overcomes the problems associated with the related art by introducing a household appliance with one or more glass inner walls providing increased illumination of the interior of the appliance and facilitating the ability to clean the inner walls by removing the parting lines.

SUMMARY OF THE INVENTION

A first aspect of the present invention is directed to a household appliance. The household appliance may include a housing defining an interior space. The housing may include a plurality of internal walls, wherein at least one of the plurality of internal walls comprises a material including glass.

A second aspect of the present invention is directed to a housing defining an interior space under a refrigeration condition. The housing may include a plurality of internal walls, wherein at least one of the plurality of internal walls comprises a material including glass.

The illustrative aspects of the present invention are designed to solve the problems herein described and other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various exemplary embodiments of the disclosure, in which.

Figure 1:
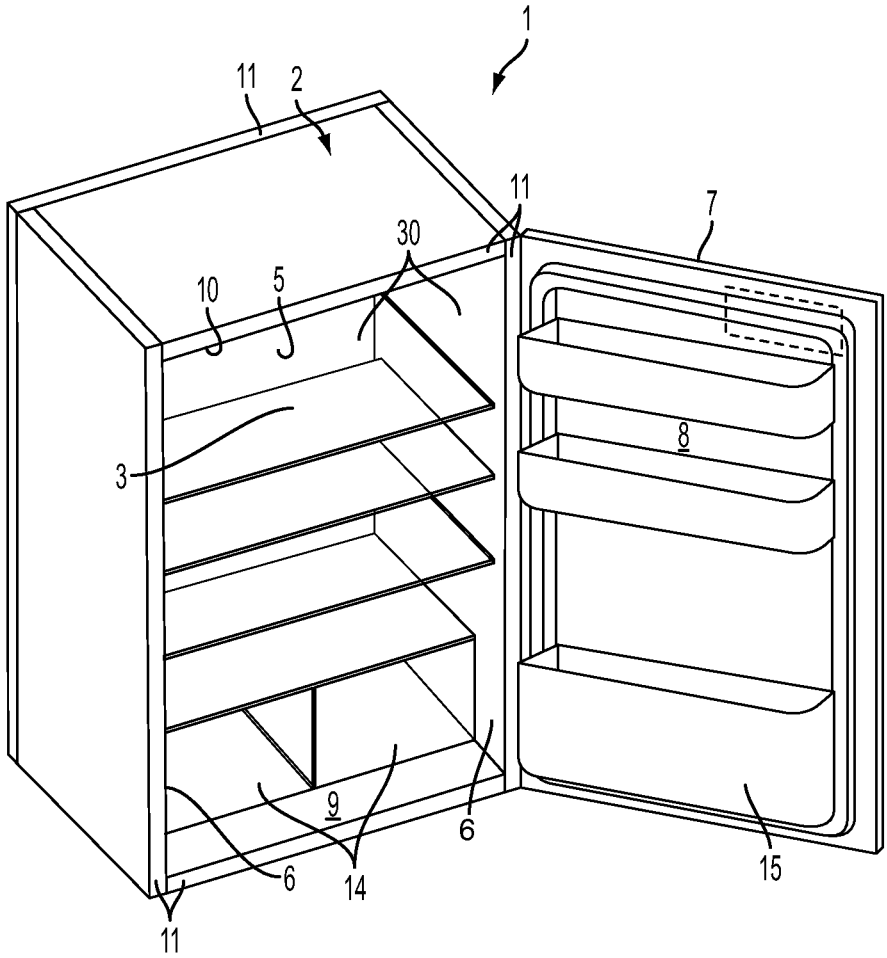
FIG. 1 depicts a household appliance including inner walls made from a glass material according to an exemplary embodiment of the invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1 shows an exemplary embodiment of a household appliance, such as a refrigerator 1. The refrigerator 1 comprises a housing 2 which is formed from a plurality of housing panels 11. The refrigerator 1 may comprise the following inner walls: a bottom area 9, respectively two side walls 6, a ceiling area 10 and a rear wall 5 and a door inner wall 8 of a door 7.

The refrigerating appliance 1 has an interior space 3 which may be fitted with base plates 13, containers 14 in the form of pull-out drawers 14, and door compartments 15 for placing or inserting food.

The rear wall 5 and the two side walls 6 may each include an organic light-emitting diode (OLED) 30 or any other lighting technology such as, e.g., light-emitting diodes (LED) or halogen bulbs to illuminate the interior 3 of the refrigerating appliance 1. Of course, the OLED's, LED's, halogen bulbs, etc. may be placed in other locations we well.

The OLED's, LED's, halogen bulbs, etc. may be integrated in the corresponding inner walls 5, 6 of the refrigerating appliance 1 in a manner such as disclosed in U.S. Pat. No. 7,588,340, incorporated herein by reference, and commonly owned by BSH Bosch and Siemens Hausgeräte GmbH.

In FIG. 1, the inner walls may be comprised from a material including glass.

Using glass for the inner walls improves visibility within interior space 3 as opposed to related art inner walls formed from stainless steel, because glass helps distribute the lighting throughout the interior space 3. In addition, glass is a high-value material with regards to producing a quality product as opposed to some related art stainless steel materials.

Glass is also a versatile material. For decorative or illumination purposes, the glass may be back-painted allowing for good visibility within the interior space 3.

Further, in addition to or in place of back-painting, the glass may be a laminated glass including a sheet of a plastic material disposed between sheets of glass. The plastic material may be chosen for cosmetic purposes, for insulation, or to improve visibility within the interior space 3 based on the placement of the lighting within the interior space 3.

For safety purposes, the glass inner walls may be formed from a tempered glass. Also, the glass may include a plurality of panes, and wherein between adjacent panes, a gas, such as air is disposed. The air trapped between the adjacent panes of glass may serve as an insulator to increasing the energy efficiency of the refrigerator 1 and help prevent the formation of frost by reducing the movement of cooler air and the subsequent accumulation of water vapor.

Of course, the invention is not limited to the aforementioned glass compositions and other glass compositions known in the related art are envisioned including annealed glass, slumped glass, casted glass, laminated glass, etc.

Figure 2:
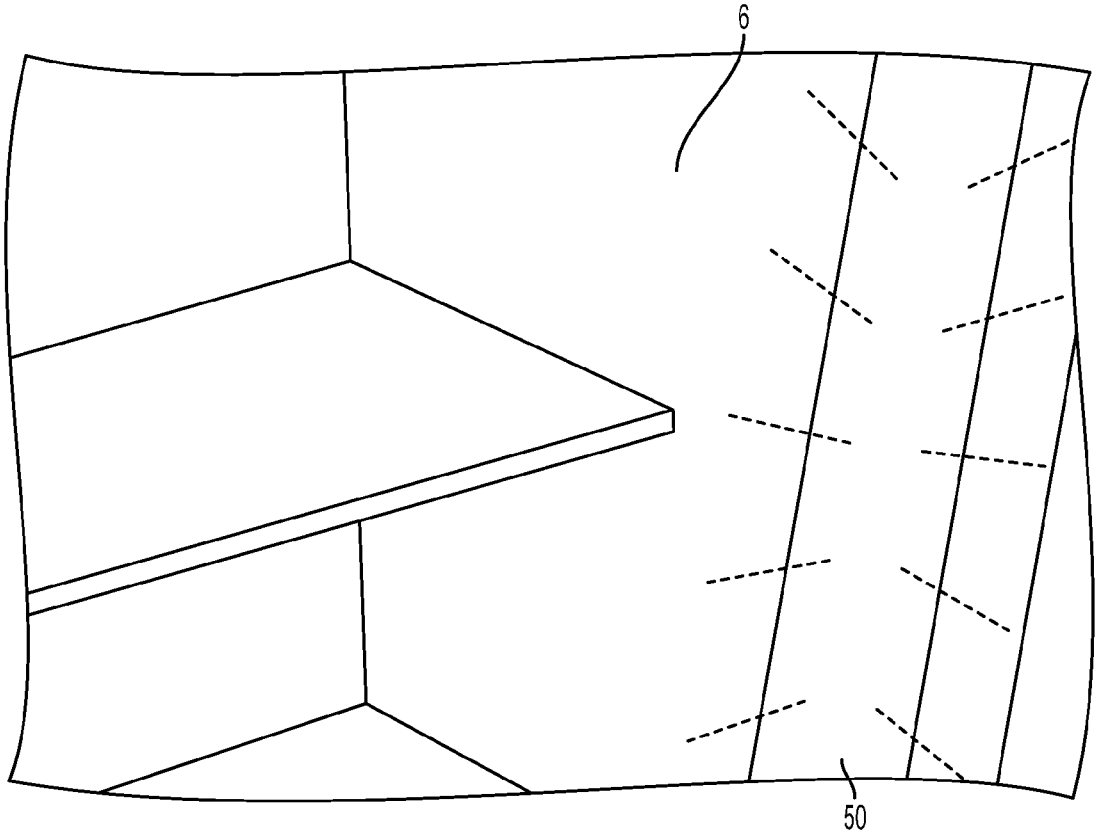
FIG. 2 depicts an interface between a side wall of the household appliance and a light housing according to an exemplary embodiment of the invention.

FIG. 2 depicts another exemplary embodiment of the invention. In FIG. 2, rather than use OLED's, LED's, halogen bulbs, etc. to light the interior space 3 of the refrigerator 1, an internal lighting system 50 may be disposed within the housing for illuminating at least a portion of the interior space 3.

As shown in FIG. 2, the interface between a side wall 6 and the light housing 50 allows for fabrication such that no parting lines are created, that is, so as to give a seamless appearance between the glass portions of light housing 50 and side wall 6. This helps to improve the ability to clean the refrigerator 1.

Figure 3:
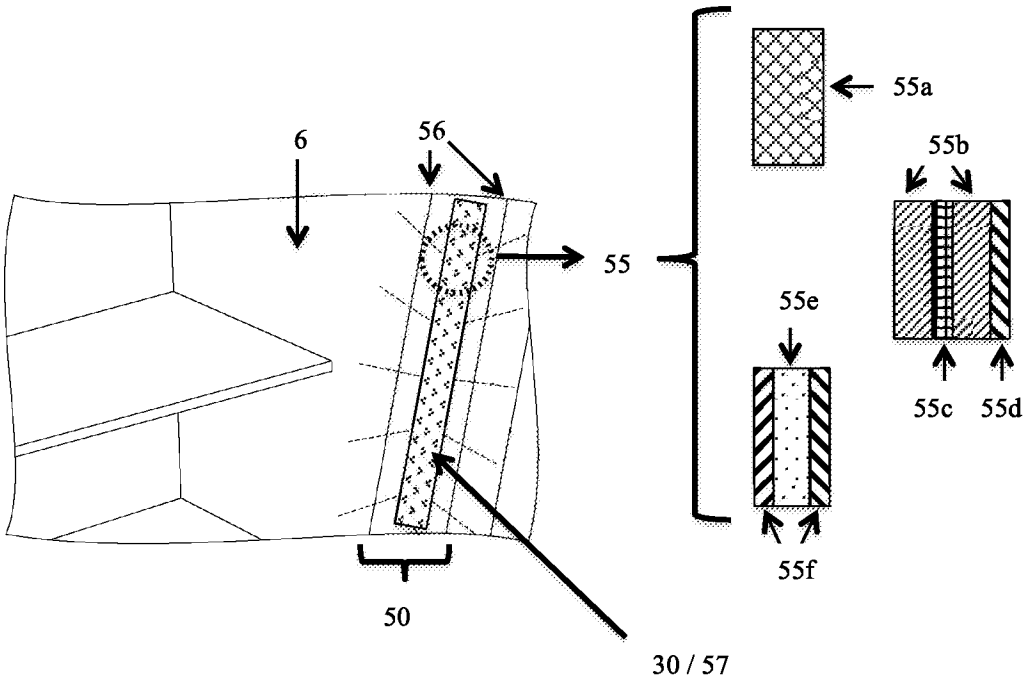
FIG. 3 depicts various embodiments of light housing 50 including various glass portions/plates 55, 55*a-f*.

FIG. 3 depicts additional exemplary embodiments of the invention. The figure illustrates glass portion/plate 55 may be a component plate for an Organic Light Emitting Diode ("OLED"). For instance, OLED 30 may include glass plate 55 and may similar or equivalent to the glass plate(s) 19 as described in Column 6, about lines 52-65, or from line 55 of Column 4 to line 49 of Column 7 in U.S. Pat. No. 7,588,340. That is, an OLED may include a transparent plate, which may be glass. The glass plate may operate as a substrate for one or more OLEDs. Glass portion/plate 55, in an additional exemplary embodiment, may be a cover plate for an underlying LED, halogen bulb, or other light source 57, as a part of light housing 50. That is, light housing 50 may comprise an internal lighting system disposed within the household appliance for illuminating at least a portion of the interior space of the appliance.

In either instance described above, glass portion/plate 55 may be constructed such that the demarcation point 56 presents a seamless construction between glass portion/plate 55 and adjoining sidewall 6, such that no parting lines are created.

Various embodiments of glass portion/plate 55 include that illustrated by element 55*a*, where the cross-hatch illustrates that a back-side of glass portion/plate 55 may be painted, or back-painted. Elements 55*b* illustrates glass that has been laminated by layers 55*c* and 55*d*. Layers 55*c* and 55*d* may be a laminate, for instance, a polymer, oligomer, or small functional molecule layer. That is, the laminate layers 55*c* and 55*d* may be of a plastic material, and may be simply a single layer of glass 55*b* with a single laminate layer 55*c*, or may comprise multiple layers of glass and/or laminates.

Elements 55*e* and 55*f* illustrate additional embodiments of the invention where glass portion/plate 55 comprises multiple layers of glass 55*f*, where gas 55*e* is disposed between the layers 55*f*. In at least one exemplary embodiment of the invention, the gas 55*e* is air.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A household appliance, comprising:

a housing defining an interior space, the housing including a plurality of internal walls, wherein a wall of the plurality of internal walls comprises a single, continuous sheet of glass that forms an entire extent of an inner-most surface of the wall, the sheet of glass having a light transmissive portion and a non-light transmissive portion, the glass is adapted to transmit light from a light source integrated in the wall, through the light transmissive portion, to provide substantially uniform lighting in the interior space of the household appliance, and the glass is seamless and abuts another wall of the internal walls, the other wall being non-parallel to the wall.

2. The household appliance according to claim 1, wherein the glass is back-painted.

3. The household appliance according to claim 1, wherein the glass is a tempered glass.

4. The household appliance according to claim 1, wherein the glass is a laminated glass including one or more sheets of glass.

5. The household appliance according to claim 4, wherein the laminated glass further includes one or more sheets of a plastic material.

6. The household appliance according to claim 1, wherein the glass includes a plurality of parallel panes, and a gas is disposed between adjacent parallel panes.

7. The household appliance according to claim 6, wherein the gas is air.

8. The household appliance according to claim 1, wherein the internal light source is disposed on a side of the glass that is opposite to the interior of the household appliance.

9. The household appliance according to claim 8, wherein the light source includes at least one of an organic light-emitting diode (OLED), a light-emitting diode (LED), and a halogen bulb for illuminating at least a portion of the interior space.

10. A housing defining an interior space under a refrigeration condition, the housing comprising:

a plurality of internal walls, wherein a wall of the plurality of internal walls comprises a single, continuous sheet of glass that forms an entire extent of an inner-most surface of the wall, the sheet of glass including a light transmissive portion and a non-light transmissive portion, the glass is adapted to transmit light, through the light transmissive portion, from a light source integrated in the wall to provide substantially uniform lighting in the interior space of the housing, and the glass is seamless and abuts another wall of internal walls, the other wall being non-parallel to the wall.

11. The housing according to claim 10, wherein the glass is back-painted.

12. The housing according to claim 10, wherein the glass is a tempered glass.

13. The housing according to claim 10, wherein the glass is a laminated glass including one or more sheets of glass.

14. The housing according to claim 13, wherein the laminated glass further includes one or more sheets of a plastic material.

15. The housing according to claim 10, wherein the glass includes a plurality of parallel panes, and a gas is disposed between adjacent parallel panes.

16. The housing according to claim 15, wherein the gas is air.

17. The housing according to claim 10, wherein the internal light source is disposed on a side of the glass that is opposite to the interior of the household appliance.

18. The housing according to claim 17, wherein the light source includes at least one of an organic light-emitting diode (OLED), a light-emitting diode (LED), and a halogen bulb for illuminating at least a portion of the interior space.

19. A household refrigerator, comprising:

a refrigerated compartment delimited by a plurality of internal surfaces, each of the internal surfaces being associated with a different wall of the household refrigerator, wherein an internal surface of the plurality of internal surfaces is made of glass which comprises a single, continuous sheet, the sheet of glass has a light transmissive portion and a non-light transmissive portion, and the glass extends seamlessly along an entire extent of an inner-most surface of the wall.

20. The household refrigerator according to claim 19, further comprising a light source integrated into a wall such that light transmits through the glass and into the refrigerated compartment.

21. The household refrigerator according to claim 19, wherein the entire extent is defined as extending at least between a second wall and at least one of a third wall and an edge that abuts a door.

22. A household refrigerator, comprising:

a refrigerated compartment delimited by a plurality of internal surfaces, each of the internal surfaces being associated with a different wall of the household refrigerator, wherein an internal surface of the plurality of internal surfaces is made of glass which comprises a single, continuous sheet that forms an entire extent of the internal surface, the glass has a light transmissive portion and a non-light transmissive portion, and the glass is seamless between the light transmissive portion and the non-light transmissive portion.

* * * * *